US011404006B2

(12) United States Patent
Xue

(10) Patent No.: US 11,404,006 B2
(45) Date of Patent: Aug. 2, 2022

(54) GOA CIRCUIT AND DISPLAY PANEL

(71) Applicant: Shenzhen China Star Optoelectronics Semiconductor Display Technology Co., Ltd., Shenzhen (CN)

(72) Inventor: Yan Xue, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 240 days.

(21) Appl. No.: 16/765,183

(22) PCT Filed: May 11, 2020

(86) PCT No.: PCT/CN2020/089548
§ 371 (c)(1),
(2) Date: May 19, 2020

(87) PCT Pub. No.: WO2021/203508
PCT Pub. Date: Oct. 14, 2021

(65) Prior Publication Data

US 2022/0114967 A1 Apr. 14, 2022

(30) Foreign Application Priority Data

Apr. 10, 2020 (CN) ..... 202010279069.8

(51) Int. Cl.
*G09G 3/3266* (2016.01)

(52) U.S. Cl.
CPC ... *G09G 3/3266* (2013.01); *G09G 2300/0408* (2013.01); *G09G 2300/0809* (2013.01);
(Continued)

(58) Field of Classification Search
None
See application file for complete search history.

(56) References Cited

U.S. PATENT DOCUMENTS

2015/0131771 A1 5/2015 Hu et al.
2018/0052480 A1 2/2018 Zhang
(Continued)

FOREIGN PATENT DOCUMENTS

CN 103400558 11/2013
CN 105489180 4/2016
(Continued)

*Primary Examiner* — Nitin Patel
*Assistant Examiner* — Amen W Bogale

(57) ABSTRACT

A gate driver of array (GOA) circuit and a display panel are disclosed and include a plurality of cascaded GOA units including a node and a pull-up control module, a pull-up module, a transfer-down module, a pull-down module, and a pull-down holding module electrically connected to the node. The pull-up control module pulls up a potential of the node. Under control of which, the pull-up module and the transfer-down module output an output signal and a stage-transfer signal, respectively. The pull-down module pulls the node and the stage-transfer signal down to a low potential. The pull-down holding module maintains the node and the stage-transfer signal at the low potential. The pull-up control module includes a voltage-stabilization module electrically connected to and dividing a voltage of, the node. Thus, ripples at pre-charging points and output signals in the GOA circuit can be reduced.

16 Claims, 3 Drawing Sheets

(52) U.S. Cl.
CPC . *G09G 2310/08* (2013.01); *G09G 2320/0214* (2013.01); *G09G 2330/021* (2013.01)

(56) References Cited

U.S. PATENT DOCUMENTS

| | | | | |
|---|---|---|---|---|
| 2018/0197448 | A1* | 7/2018 | Zhang | G09G 3/20 |
| 2019/0019456 | A1 | 1/2019 | Chen | |
| 2019/0066596 | A1 | 2/2019 | Xue et al. | |
| 2019/0163001 | A1 | 5/2019 | Gong | |
| 2019/0214104 | A1* | 7/2019 | Qian | G11C 19/28 |
| 2020/0074937 | A1 | 3/2020 | Choi | |
| 2020/0082746 | A1* | 3/2020 | Zhang | G09G 3/3677 |
| 2020/0160805 | A1* | 5/2020 | Hong | G09G 3/20 |
| 2021/0020089 | A1* | 1/2021 | Huang | G09G 3/3677 |
| 2021/0158761 | A1* | 5/2021 | Zhang | G09G 3/3266 |
| 2021/0201806 | A1* | 7/2021 | Feng | G11C 19/28 |
| 2021/0280147 | A1* | 9/2021 | Xi | G11C 19/28 |

FOREIGN PATENT DOCUMENTS

| | | |
|---|---|---|
| CN | 106489107 | 3/2017 |
| CN | 106531120 | 3/2017 |
| CN | 107230453 | 10/2017 |
| CN | 107393473 | 11/2017 |
| CN | 108010498 | 5/2018 |
| CN | 109712552 | 5/2019 |
| CN | 110060639 | 7/2019 |
| CN | 110299112 | 10/2019 |
| CN | 110875016 | 3/2020 |
| JP | 2007-242129 | 9/2007 |
| KR | 2004-0062048 | 7/2004 |
| KR | 10-0761168 | 9/2007 |
| KR | 10-2018-0072269 | 6/2018 |

* cited by examiner

GOA CIRCUIT AND DISPLAY PANEL

RELATED APPLICATIONS

This application is a National Phase of PCT Patent Application No. PCT/CN2020/089548 having International filing date of May 11, 2020, which claims the benefit of priority of Chinese Patent Application No. 202010279069.8 filed on Apr. 10, 2020. The contents of the above applications are all incorporated by reference as if fully set forth herein in their entirety.

FIELD AND BACKGROUND OF THE INVENTION

The present disclosure relates to the technical field of displays, and specifically relates to a gate driver on array (GOA) circuit and a display panel.

Gate driver on array (GOA) technology refers to technology for driving rows in an array substrate, in which a gate-scanning driving circuit is manufactured on a thin film transistor (TFT) array substrate for a liquid crystal display (LCD) or an organic light emitting diode (OLED) by adopting TFT manufacturing process, to implement a driving method in a progressive scan manner, which has advantages of reducing production costs and implementing panels with a design of narrow bezel. A GOA circuit has two fundamental functions. The first one is to output gate-scanning driving signals to drive gate lines in the panels for turning the TFT in a display region on, then to charge for pixels. The second one is a shift register function, in which after a gate-scan driving signal is output completely, next gate-scan driving signal will be output, delivered in sequence, and controlled by a clock. The GOA technology can reduce a bonding process for external integrated circuits (IC), has the opportunity to increase production capacity and reduce product costs, and can make LCD panels more suitable for making narrow-bezel display products. Currently, driving of horizontal scanning lines in an existing active-matrix organic light-emitting diode (AMOLED) display panel are implemented by the external integrated circuits which can control each stage of row-scanning lines to turn on progressively. Adopting with the GOA method, the row scanning driving circuit can be integrated on a substrate of the display panel, which can reduce a number of external ICs, thereby reducing the production cost of the display panel, and can implement the narrow bezel of the display device. In addition, indium gallium zinc oxide (IGZO) has high mobility and good device stability. It is currently widely used in IGZO-GOA circuits.

Currently, the resolutions of panels on the market are mainly divided into full high definition (FHD) and 4K, and a development of the panels with higher resolutions (such as 8K) has become a market trend. With the improvement of the resolutions of the panels, a size of thin film transistor (TFT) in a pull-up circuit in the GOA circuit must be large enough. As the size of the TFT increases, a parasitic capacitance of the TFT increases. Because a drain (Drain) terminal of the TFT is connected to a clock (CK) signal, when the CK signal raises from a low potential to a high potential, potential signal at pre-charging points are pulled up to the high potential, which easily causes buffering TFTs to turn-on in error, and then the GOA outputs a high voltage, which in turn causes data signals to be written in error.

Therefore, in order to prevent the data signal from being written in error, how to reduce ripples at pre-charging points and output signals in the GOA circuit has become a technical problem to be solved and a focus of constant research by those skilled in the art.

SUMMARY OF THE INVENTION

In view of the above, embodiments of the present disclosure provide a gate driver on array (GOA) circuit to solve a problem of data signal written in error caused by ripples at pre-charging points and output signals in existing GOA circuits.

Therefore, embodiments of the present disclosure provide technical solutions as follows.

A first aspect of the present disclosure provides a gate driver on array (GOA) circuit, including a plurality of cascaded GOA units, each of GOA units including a node Q, a pull-up control module, a pull-up module, a transfer-down module, a pull-down module, and a pull-down holding module, wherein each of the pull-up control module, the pull-up module, the transfer-down module, the pull-down module, and the pull-down holding module is electrically connected to the node Q.

The pull-up control module is configured to pull up a potential of the node Q.

The pull-up module is configured to output an output signal under control of the potential of the node Q.

The transfer-down module is configured to output a stage-transfer signal under control of the potential of the node Q.

The pull-down module is configured to pull the potential of the node Q down to a low potential and pull the output stage-transfer signal down to the low potential.

The pull-down holding module is configured to maintain the node Q at the low potential and maintain the output stage-transfer signal at the low potential.

The pull-up control module includes a voltage stabilization module electrically connected to the node Q and configured to divide a voltage of the node Q.

Further, the cascaded GOA units includes an N-th GOA unit, the N is a positive integer greater than 1, wherein the pull-up control module is input with an output signal Out(N) (also referred to as an N-th output signal) and a stage-transfer signal Cout(N−1) (also referred to as an (N−1)th stage-transfer signal), and is electrically connected to a first node Q(N), and is configured to pull up a potential of the first node Q(N) according to the output signal Out(N) under control of the stage-transfer signal Cout(N−1).

The pull-up module is input with a second clock signal CKB, and is electrically connected to the first node Q(N), and is configured to output the output signal Out(N) according to the second clock signal CKB under control of the potential of the first node Q(N).

The transfer-down module is input with the second clock signal CKB, and is electrically connected to the first node Q(N), and is configured to output a stage-transfer signal Cout(N) (also referred to as an N-th stage-transfer signal) according to the second clock signal CKB under control of the potential of the first node Q(N).

The pull-down module is input with a stage-transfer signal Cout(N+1) (also referred to as an (N+1)th stage-transfer signal), a first potential signal VGL1, a second potential signal VGL2, and the output signal Out(N), and is electrically connected to the first node Q(N), and is configured to change the potential of the first node Q(N) to a potential of the first potential signal VGL1 and change a potential of the output signal Out(N) to a potential of the second potential signal VGL2.

The pull-down holding module includes a first pull-down holding module and a second pull-down holding module.

The first pull-down holding module is input with the first potential signal VGL1, and is electrically connected to the first node Q(N) and a second node QB(N), and is configured to maintain the potential of the first node Q(N) at the potential of the first potential signal VGL1 under control of a potential of the second node QB(N).

The second pull-down holding module is input with the second potential signal VGL2 and the output signal Out(N), and is electrically connected to the second node QB(N), and is configured to maintain the output signal Out(N) at the potential of the second potential signal VGL2 under control of the potential of the second node QB(N).

Further, the voltage stabilization module includes a thin film transistor T13 (also referred to as a first thin film transistor).

A gate of the thin film transistor T13 is connected to the node Q(N).

A source and a drain of the thin film transistor T13 are input with the first potential signal VGL1.

The pull-up control module further includes a thin film transistor T11 (also referred to as a second thin film transistor), a thin film transistor T12 (also referred to as a third thin film transistor), and a thin film transistor T6 (also referred to as a fourth thin film transistor); wherein a gate of the thin film transistor T11 is input with the stage-transfer signal Cout(N−1), a source of the thin film transistor T11 is input with the output signal Out(N), and a drain of the thin film transistor T11 is electrically connected to a source of the thin film transistor T12; wherein a gate of the thin film transistor T12 is input with the stage-transfer signal Cout (N−1), and a drain of the thin film transistor T12 is electrically connected to the first node Q(N).

A gate of the thin film transistor T6 is input with the stage-transfer signal Cout(N), a source of the thin film transistor T6 is electrically connected to the drain of the thin film transistor T11, and a drain of the thin film transistor T6 is electrically connected to the pull-up module.

The pull-up module includes a thin film transistor T21 (also referred to as a fifth thin film transistor), a thin film transistor T23 (also referred to as a sixth thin film transistor), and a bootstrap capacitor Cbt; wherein the a gate of the thin film transistor T21 is electrically connected to the first node Q(N), a source of the thin film transistor T21 is input with the second clock signal CKB, and a drain of the thin film transistor T21 outputs the output signal Out(N); wherein a gate of the thin film transistor T23 is electrically connected to the first node Q(N), a source of the thin film transistor T23 is input with the second clock signal CKB, and a drain of the thin film transistor T23 is electrically connected to the drain of the thin film transistor T6; and wherein the bootstrap capacitor Cbt has two ends, one of the two ends is connected to the first node Q(N), and the other of the two ends is input with the output signal Out(N).

Further, the thin film transistor T13 and the thin film transistor T21 have a same size.

Further, the voltage stabilization module includes a thin film transistor T13, a gate of the thin film transistor T13 is connected to the node Q, and a source and a drain of the thin film transistor T13 are input with a first potential signal VGL1.

Further, the thin film transistor T13 is an indium gallium zinc oxide (IGZO) thin film transistor.

Further, the thin film transistor T13 includes a glass substrate, a gate electrode, an oxide semiconductor layer, a gate insulation layer, a source, and a drain, which are stacked.

Further, the inverter includes a thin film transistor T51 (also referred to as a seventh thin film transistor), a thin film transistor T52 (also referred to as an eighth thin film transistor), a thin film transistor T53 (also referred to as a ninth thin film transistor), and a thin film transistor T54 (also referred to as a tenth thin film transistor); wherein a gate and a source of the thin film transistor T51 are input with a constant high-potential voltage VGH, and a drain of the thin film transistor T51 is electrically connected to a source of the thin film transistor T52; wherein a gate of the thin film transistor T52 is electrically connected to the first node Q(N), and a drain of the thin film transistor T52 is input with the first potential signal VGL1; wherein a gate of the thin film transistor T53 is electrically connected to the drain of the thin film transistor T51, a source of the thin film transistor T53 is input with the constant high-potential voltage VGH, and a drain of the thin film transistor T53 is electrically connected to the second node QB(N); and wherein a gate of the thin film transistor T54 is electrically connected to the first node Q(N), a source of the thin film transistor T54 is electrically connected the second node QB(N), and a drain of the thin film transistor T54 is input with the first potential signal VGL1.

A second aspect of the present disclosure provides a display panel, which includes anyone type of GOA circuit mentioned as the first aspect.

The embodiments of the present disclosure provide a GOA circuit. In an existing GOA circuit, as a size of thin film transistor increases, a parasitic capacitance of the thin film transistor increases. Because a drain of the thin film transistor is connected to a clock signal, when the clock signal raises from a low potential to a high potential, a potential signal at a pre-charging point is pulled up to the high potential, which easily causes a buffering thin film transistor to turn-on in error, and then the GOA outputs a high voltage, which in turn causes data signals to be written in error. In the present disclosure, a ripple at a pre-charging point can be suppressed by dividing a voltage at the pre-charging point via a voltage stabilization module.

BRIEF DESCRIPTION OF THE SEVERAL VIEWS OF THE DRAWINGS

In order to more clearly explain technical solutions in the specific embodiments of the present disclosure or the prior art, a description of drawings required for the specific embodiments or the prior art will be briefly introduced as follows. Obviously, the drawings in the following description are some embodiments of the present disclosure. For those of ordinary skill in the art, other drawings can be obtained based on these drawings, without paying any creative work.

DESCRIPTION OF SPECIFIC EMBODIMENTS OF THE INVENTION

Figure 1:
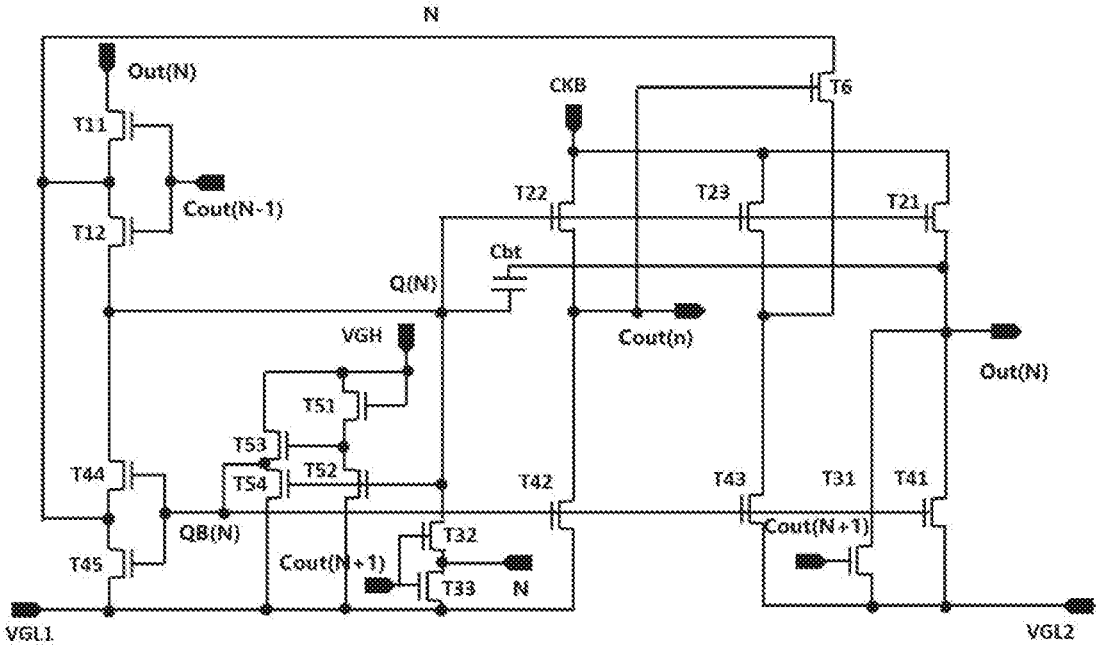
FIG. 1 is a circuit diagram of an existing gate driver on array (GOA) circuit.

Technical solutions in the embodiments of the present disclosure will be described clearly and completely with reference to drawings in the embodiments of the present disclosure. Obviously, the described embodiments are only a part of the embodiments of the present disclosure, but not all of the embodiments. Based on the embodiments in the present disclosure, all other embodiments obtained by those skilled in the art without making creative work fall within the protection scope of the present disclosure.

In a description of the present disclosure, it should be understood that, terms, such as "center", "longitudinal", "transversal", "length", "width", "thickness", "upper", "lower", "front", "back", "left", "right", "vertical", "horizontal", "top", "bottom", "inner", "outer", "clockwise", and "counterclockwise", which indicate orientation or positional relationship, is the orientation or positional relationship based on the shown drawings, and is only for convenience of describing the present disclosure and simplifying the description, rather than indicating or implying that referred devices or elements must have a specific orientation, be constructed and operated in a specific orientation, Therefore, it cannot be understood as a limitation to the present disclosure. In addition, terms, such as "first" and "second" are only used for descriptive purposes, and cannot be understood as indicating or implying the relative importance or implicitly indicating a number of indicated technical features. Thus, the features defined as "first" and "second" may explicitly or implicitly include one or more of the features. In the description of the present disclosure, a meaning of "plurality" is two or more, unless otherwise specifically limited.

In the description of the present disclosure, it should be noted that, unless otherwise clearly specified and limited, terms, "installation", "connected", and "connection", should be understood in a broad sense. For example, it may be fixed or detachable connected, or integrally connected; it may be mechanically connected, electrically connected, or can communicate with each other; it can be directly connected, or it can be indirectly connected via an intermedia, which can be a connection between two elements or an interaction of two elements relationship. Those of ordinary skill in the art can understand specific meanings of the above terms in the present disclosure according to specific situations.

In the present disclosure, unless otherwise clearly specified and defined, the first feature "above" or "below" the second feature may include the first and second features in direct contact, or may include that the first and second features is not in direct contact but via other features between them. Moreover, the first feature "above", "over" and "upon" the second feature includes that, the first feature is directly above and obliquely above the second feature, or simply means that the first feature is higher in level than the second feature. The first feature is "below", "under" and "beneath" the second feature includes that, the first feature is directly below and obliquely below the second feature, or simply means that the first feature is lower in level than the second feature.

The following disclosure provides many different embodiments or examples for implementing different structures of the present disclosure. In order to simplify the present disclosure, parts and configurations of specific examples are described below. Certainly, they are only examples, and the purpose is not to limit the present disclosure. In addition, reference numerals and/or reference letters in different examples of the present disclosure may be repeatedly referred. Such repetition is for simplicity and clarity, and it does not indicate the relationship between the discussed various embodiments and/or configurations. In addition, the present disclosure provides examples of various specific processes and materials, but those of ordinary skill in the art may be aware of an application of other processes and/or a use of other materials.

Figure 2:
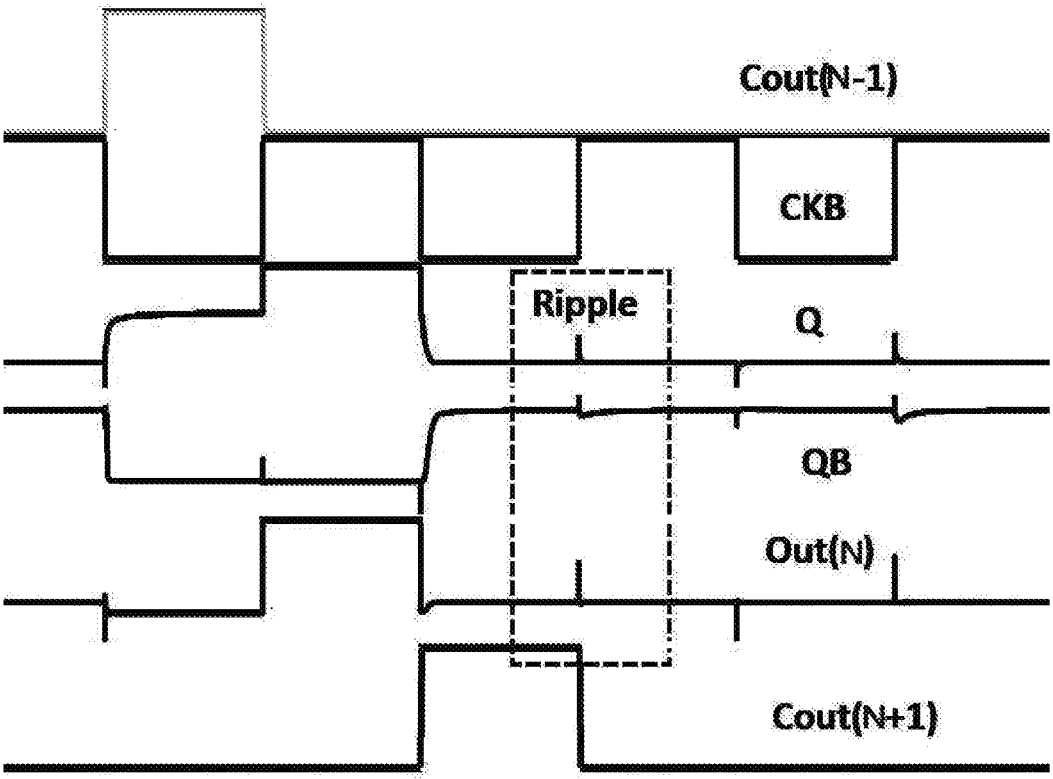
FIG. 2 is an output signal diagram of the GOA circuit shown in FIG. 1.
Figure 3:
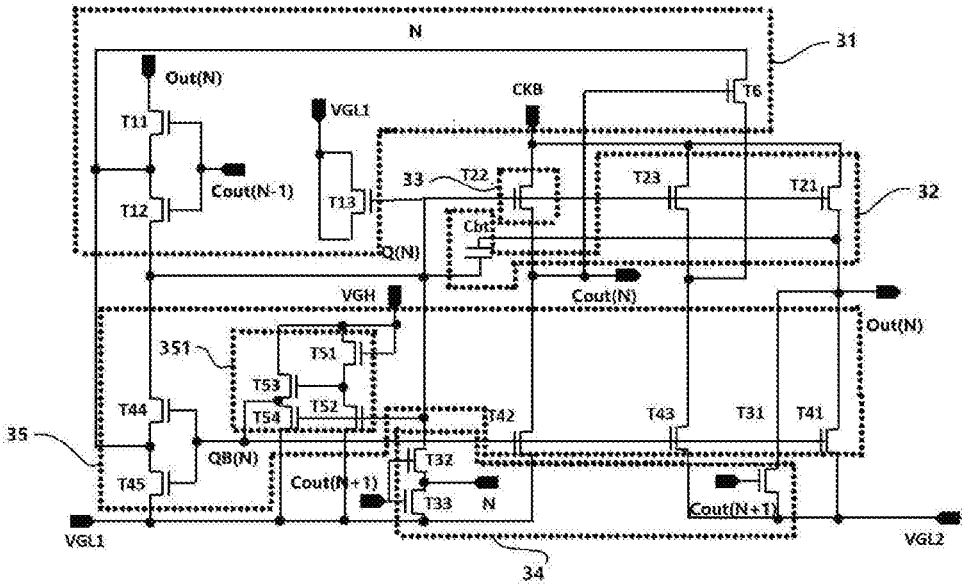
FIG. 3 is a circuit diagram of a GOA circuit, according to an embodiment of the present disclosure.

GOA, i.e. gate driver on array or gate on array, is a design in a thin film transistor liquid crystal display (TFT-LCD), in which a basic concept is to integrate a gate driver of an LCD panel on a glass substrate to form a scanning driving configuration for the panel. Compared with traditional processes of chip on film (COF) and chip on glass (COG), GOA technology not only saves costs, but also can save a process of bonding in a direction of gates, which is extremely beneficial to increase production capacity and improves an integration of TFT-LCD panels. The GOA technology can decrease usage quantity of gate-driving integrated circuit (IC) and reduce power consumption and costs, thereby being a green technology. An existing GOA circuit includes multi-stage of GOA units, wherein each GOA unit includes a pull-up control module, a pull-up module, a transfer-down module, a pull-down module, and a pull-down holding module. The pull-up control module is used to pull up a potential of a first node. The pull-up module is used to output an output signal under control of the potential of the first node. The transfer-down module is used to output a stage-transfer signal under control of the potential of the first node. The pull-down module is used to pull down the potential of the first node and a potential of the output signal. The pull-down holding module is used to maintain the potentials of the first node and the output signal at a low potential under control of the potential of the first node. FIG. 1 is a circuit diagram of an existing gate driver on array (GOA) circuit. FIG. 2 is an output signal diagram of the GOA circuit shown in FIG. 1. As shown in FIG. 2, when a second clock signal CKB raises from a low potential to a high potential, a potential of a point Q is coupled to a high potential, which causes a T21 to turn-on in error and an Out(N) to be output in error, and finally causes a data signal is written in error. FIG. 3 is a circuit diagram of a GOA circuit, according to an embodiment of the present disclosure. As shown in FIG. 3, the present disclosure provides a GOA circuit, which includes a plurality of cascaded GOA units, each of GOA units includes a node Q, a pull-up control module 31, a pull-up module 32, a transfer-down module 33, a pull-down module 34, and a pull-down holding module 35, wherein each of the pull-up control module 31, the pull-up module 32, the transfer-down module 33, the pull-down module 34, and the pull-down holding module 35 is electrically connected to the node Q. The pull-up control module 31 is configured to pull up a potential of the node Q. The pull-up module 32 is configured to output an output signal under control of the potential of the node Q. The transfer-down module 33 is configured to output a stage-transfer signal under control of the potential of the node Q. The pull-down module 34 is configured to pull the potential of the node Q down to a low potential and pull the output stage-transfer signal down to the low potential. The pull-down holding module 35 is configured to maintain the node Q at the low potential and maintain the output stage-transfer signal at the low potential. The pull-up control module 31 includes a voltage stabilization module, which is electrically connected to the node Q and configured to divide a voltage of the node Q.

In the present embodiment, the voltage stabilization module is configured to divide the voltage of the node Q under control of the point Q.

Different from the prior art, the present disclosure provides a GOA circuit. In the GOA circuit, the pull-up control module 31 includes the voltage stabilization module, which is configured to divide the voltage of the node Q under control of the point Q, which can suppress a ripple of the node Q.

In a specific embodiment, the voltage stabilization module includes a thin film transistor T13 (also referred to as a first thin film transistor), wherein a gate of the thin film transistor T13 is connected to the node Q, and a source and a drain of the thin film transistor T13 are input with a first potential signal VGL1.

Figure 4:
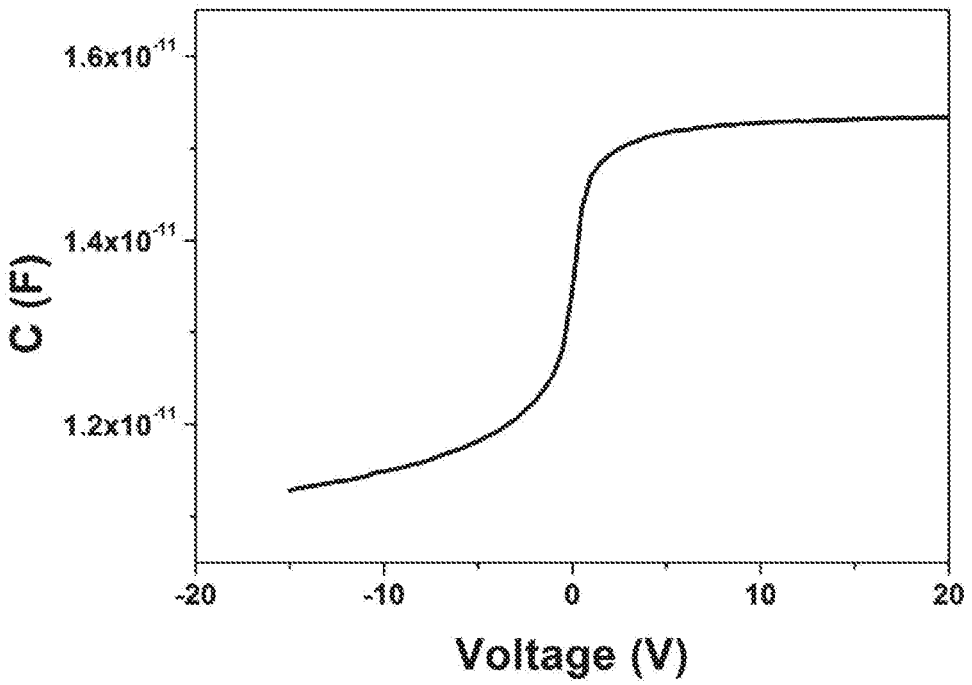
FIG. 4 is a C-V curve diagram of T13 in the GOA circuit shown in FIG. 3.
Figure 5:
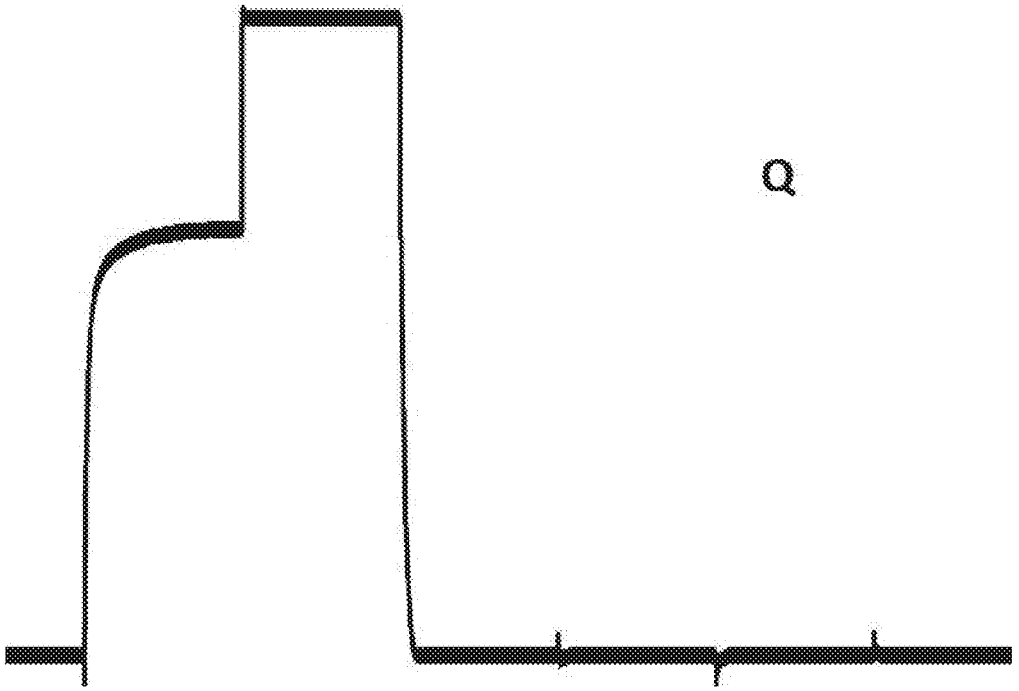
FIG. 5 is a diagram of an output waveform at a point Q in the GOA circuit shown in FIG. 3.

FIG. 4 is a C-V curve diagram of the T13 in the GOA circuit shown in FIG. 3. As shown in FIG. 4, the point Q controls a top-gate part of the T13. The first potential signal VGL1 controls a bottom-gate part of the thin film transistor T13. When the second clock signal CKB raises from a low potential to a high potential, if the potential of the point Q is coupled to the high potential by the second clock signal CKB, then the thin film transistor T13 turns on. When the thin film transistor T13 turns on, the thin film transistor T13 has an on-state capacitance which is relatively large, and a parasitic capacitance of the thin film transistor T13 can be used to divide the voltage at the point Q. FIG. 5 is a diagram of an output waveform at a point Q in the GOA circuit shown in FIG. 3. As shown in FIG. 5, the ripple at the point Q is effectively suppressed, compared with the traditional GOA circuit.

In a specific embodiment, the thin film transistor T13 and the thin film transistor T21 have a same size (W:L=2000 μm:8 μm). Meanwhile, the thin film transistor T31 has a feedback function. If an ability of the second clock signal CKB coupling to the point Q via the thin film transistor T21, the thin film transistor T22, and the thin film transistor T23 is not strong, then the thin film transistor T13 turns on weakly, the parasitic capacitance of the thin film transistor T13 is also relatively small, and the voltage divided to the point Q is also relatively small.

In a specific embodiment, the thin film transistor T13 is an indium gallium zinc oxide (IGZO) thin film transistor.

Different from the prior art, the present disclosure provides a GOA circuit, which includes the IGZO thin film transistor, which has high mobility and good device stability.

In a specific embodiment, the thin film transistor T13 includes a glass substrate, a gate electrode, an oxide semiconductor layer, a gate insulation layer, a source, and a drain, wherein the glass substrate, the gate electrode, the oxide semiconductor layer, the gate insulation layer, the source, and the drain are stacked.

In a specific embodiment, an N is set to a positive integer, in addition to the first and last GOA units, in an N-th GOA unit, the pull-up control module 31 is input with an output signal Out(N) (also referred to as an N-th output signal) of the N-th GOA unit and an stage-transfer signal Cout(N−1) (also referred to as an (N−1)th stage-transfer signal) of an (N−1)th GOA unit, and is electrically connected to a first node Q(N), and is configured to pull up the potential of the first node Q(N) according to the output signal Out(N) of the N-th GOA unit under control of the stage-transfer signal Cout(N−1) of the (N−1)th GOA unit.

In addition, the pull-up module 32 is input with the second clock signal CKB, and is electrically connected to the first node Q(N), and is configured to output the output signal Out(N) according to the second clock signal CKB under control of the potential of the first node Q(N).

In addition, the transfer-down module 33 is input with the second clock signal CKB, and is electrically connected to the first node Q(N), and is configured to output a stage-transfer signal Cout(N) (also referred to as an N-th stage-transfer signal) according to the second clock signal CKB under control of the potential of the first node Q(N).

In addition, the pull-down module 34 is input with a stage-transfer signal Cout(N+1) (also referred to as an (N+1)th stage-transfer signal), the first potential signal VGL1, a second potential signal VGL2, and the output signal Out(N), and is electrically connected to the first node Q(N), and is configured to change the potential of the first node Q(N) to a potential of the first potential signal VGL1 and change a potential of the output signal Out(N) to a potential of the second potential signal VGL2.

In addition, the pull-down holding module 35 includes a first pull-down holding module and a second pull-down holding module.

Specifically, the first pull-down holding module is input with the first potential signal VGL1, and is electrically connected to the first node Q(N) and a second node QB(N), and is configured to maintain the potential of the first node Q(N) at the potential of the first potential signal VGL1 under control of a potential of the second node QB(N).

In addition, the second pull-down holding module is input with the second potential signal VGL2 and the output signal Out(N), and is electrically connected to the second node QB(N), and is configured to maintain the output signal Out(N) at the potential of the second potential signal VGL2 under control of the potential of the second node QB(N).

In a specific embodiment, the voltage stabilization module includes a thin film transistor T13.

Specifically, a gate of the thin film transistor T13 is connected to the node Q(N).

In addition, a source and a drain of the thin film transistor T13 are input with the first potential signal VGL1.

In addition, the pull-up control module 31 further includes a thin film transistor T11 (also referred to as a second thin film transistor), a thin film transistor T12 (also referred to as a third thin film transistor), and a thin film transistor T6 (also referred to as a fourth thin film transistor). A gate of the thin film transistor T11 is input with the stage-transfer signal Cout(N−1) of the (N−1)th GOA unit, a source of the thin film transistor T11 is input with the output signal Out(N) of the N-th GOA unit, and a drain of the thin film transistor T11 is electrically connected to a source of the thin film transistor T12. A gate of the thin film transistor T12 is input with the stage-transfer signal Cout(N−1) of the (N−1)th GOA unit, and a drain of the thin film transistor T12 is electrically connected to the first node Q(N).

In addition, a gate of the thin film transistor T6 is input with the stage-transfer signal Cout(N) of an N-th GOA unit, a source of the thin film transistor T6 is electrically connected to the drain of the thin film transistor T11, and a drain of the thin film transistor T6 is electrically connected to the pull-up module 32.

The pull-up module 32 includes a thin film transistor T21 (also referred to as a fifth thin film transistor), a thin film transistor T23 T23 (also referred to as a sixth thin film transistor), and a bootstrap capacitor Cbt. The a gate of the thin film transistor T21 is electrically connected to the first node Q(N), a source of the thin film transistor T21 is input with the second clock signal CKB, and a drain of the thin film transistor T21 outputs the output signal Out(N). A gate of the thin film transistor T23 is electrically connected to the first node Q(N), a source of the thin film transistor T23 is input with the second clock signal CKB, and a drain of the thin film transistor T23 is electrically connected to the drain of the thin film transistor T6. The bootstrap capacitor Cbt has two ends, one of the two ends is connected to the first node Q(N) and the other of the two ends is input with the output signal Out(N).

In a specific embodiment, the thin film transistor T13 and the thin film transistor T21 have a same size.

In the present embodiment, the thin film transistor T13 and the thin film transistor T21 have the same size. Thus, the thin film transistor T13 has an on-state capacitance which is relatively large, and a parasitic capacitance of the thin film transistor T13 can be used to divide the voltage at the point Q(N), and the ripple at the point Q(N) is effectively suppressed.

In a specific embodiment, the first pull-down holding module includes an inverter 351. The inverter 351 has an input terminal and an output terminal, the input terminal is electrically connected to the first node Q(N), and the output terminal is electrically connected to the second node QB(N).

In a specific embodiment, the inverter 351 includes a thin film transistor T51 (also referred to as a seventh thin film transistor), a thin film transistor T52 (also referred to as an eighth thin film transistor), a thin film transistor T53 (also referred to as a ninth thin film transistor), and a thin film transistor T54 (also referred to as a tenth thin film transistor. A gate and a source of the thin film transistor T51 are input with a constant high-potential voltage VGH, and a drain of the thin film transistor T51 is electrically connected to a source of the thin film transistor T52. A gate of the thin film transistor T52 is electrically connected to the first node Q(N), and a drain of the thin film transistor T52 is input with the first potential signal VGL1. A gate of the thin film transistor T53 is electrically connected to the drain of the thin film transistor T51, a source of the thin film transistor T53 is input with the constant high-potential voltage VGH, and a drain of the thin film transistor T53 is electrically connected to the second node QB(N). A gate of the thin film transistor T54 is electrically connected to the first node Q(N), a source of the thin film transistor T54 is electrically connected the second node QB(N), and a drain of the thin film transistor T54 is input with the first potential signal VGL1.

In a specific embodiment, a width-to-length ratio of the thin film transistor T13 is 2000 μm:8 μm.

In a specific embodiment, the N is set to a positive integer, in addition to the first and last GOA units, in the N-th GOA unit, the pull-up control module 31 includes the voltage stabilization module. The voltage stabilization module includes the thin film transistor T13. The gate of the thin film transistor T13 is connected to the node Q(N). The source and the drain of the thin film transistor T13 are input with the first potential signal VGL1. The pull-up control module 31 further includes the thin film transistor T11, the thin film transistor T12, and the thin film transistor T6. The gate of the thin film transistor T11 is input with the stage-transfer signal Cout(N−1) of the (N−1)th GOA unit, the source of the thin film transistor T11 is input with an output signal Out(N) of the N-th GOA unit, and the drain of the thin film transistor T11 is electrically connected to the source of the thin film transistor T12. The gate of the thin film transistor T12 is input with the stage-transfer signal Cout(N−1) of the (N−1)th GOA unit, and the drain of the thin film transistor T12 is electrically connected to the first node Q(N). The gate of the thin film transistor T6 is input with the stage-transfer signal Cout(N) of N-th GOA unit, the source of the thin film transistor T6 is electrically connected to the drain of the thin film transistor T11, and the drain of the thin film transistor T6 is electrically connected to the pull-up module 32.

In addition, the pull-up module 32 includes the thin film transistor T21, the thin film transistor T23, and the bootstrap capacitor Cbt. The gate of the thin film transistor T21 is electrically connected to the first node Q(N), the source of thin film transistor T21 is input with the second clock signal CKB, and the drain of the thin film transistor T21 outputs the output signal Out(N). The gate of the thin film transistor T23 is electrically connected to the first node Q(N), the source of the thin film transistor T23 is input with the second clock signal CKB, and the drain of the thin film transistor T23 is electrically connected to the drain of the thin film transistor T6. The bootstrap capacitor Cbt has two ends, one of the two ends is connected to the first node Q(N), and the other of the two ends is input with the output signal Out(N).

In addition, the transfer-down module 33 includes the thin film transistor T22. A gate of the thin film transistor T22 is electrically connected to the first node Q(N). A source of the thin film transistor T22 is input with the second clock signal CKB. A drain of the thin film transistor T22 outputs the stage-transfer signal Cout(N).

In addition, the pull-down module 34 includes the thin film transistor T31, a thin film transistor T32, and a thin film transistor T33. A gate of the thin film transistor T31 is input with the stage-transfer signal Cout(N+1) of the (N+1)th GOA unit, a source of the thin film transistor T31 is input with an output signal Out(N), and a drain of the thin film transistor T31 is input with the second potential signal VGL2. A gate of the thin film transistor T32 is input with the stage-transfer signal Cout(N+1) of the (N+1)th GOA unit, a source of the thin film transistor T32 is electrically connected to the first node Q(N), and a drain of the thin film transistor T32 is electrically connected to a source of the thin film transistor T33 and the source of the thin film transistor T6. A gate of the thin film transistor T33 is input with the stage-transfer signal Cout(N+1) of the (N+1)th GOA unit, and a drain of the thin film transistor T33 is input with the first potential signal VGL1.

In addition, the pull-down holding module 35 includes the inverter 351. The inverter 351 includes the thin film transistor T51, the thin film transistor T52, the thin film transistor T53, and the thin film transistor T54. The gate and the source of the thin film transistor T51 are input with the constant high-potential voltage VGH, and the drain of the thin film transistor T51 is electrically connected to the source of the thin film transistor T52. The gate of the thin film transistor T52 is electrically connected to the first node Q(N), and the drain of the thin film transistor T52 is input with the first potential signal VGL1. The gate of the thin film transistor T53 is electrically connected to the drain of the thin film transistor T51, the source of the thin film transistor T53 is input with the constant high-potential voltage VGH, and the drain of the thin film transistor T53 is electrically connected to the second node QB(N). The gate of the thin film transistor T54 is electrically connected to the first node Q(N), the source of the thin film transistor T54 is electrically connected the second node QB(N), and the drain of the thin film transistor T54 is input with the first potential signal VGL1.

In addition, the pull-down holding module 35 further includes a thin film transistor T41, a thin film transistor T42, a thin film transistor T43, a thin film transistor T44, and a thin film transistor T45. A gate of the thin film transistor T41 is electrically connected to the second node QB(N), a source of the thin film transistor T41 is input with the output signal Out(N), and a drain of the thin film transistor T41 is input with the second potential signal VGL2. A gate of the thin film transistor T42 is electrically connected to the second node QB(N), a source of the thin film transistor T42 is input with the stage-transfer signal Cout(N), and a drain of the thin film transistor T42 is input with the first potential signal VGL1. A gate of the thin film transistor T43 is electrically connected to the second node QB(N), a source of the thin film transistor T43 is electrically connected to the drain of the thin film transistor T6, and a drain of the thin film transistor T43 is input with the second potential signal VGL2. A gate of the thin film transistor T44 is electrically connected to the second node QB(N), a source of the thin film transistor T44 is electrically connected to the first node Q(N), and a drain of the thin film transistor T44 is electrically connected to a source of the thin film transistor T45 and the source of the thin film transistor T6. A gate of the thin film transistor T45 is electrically connected to the second node QB(N), and a drain of the thin film transistor T45 is input with the first potential signal VGL1.

Different from the prior art, the present disclosure provides a GOA circuit, which includes a plurality of cascaded GOA units, each of GOA units, each of GOA units includes the pull-up control module 31, the pull-up module 32, the transfer-down module 33, the pull-down module 34, and the pull-down holding module 35. The pull-up control module 31 includes the thin film transistor T13 which has a double-gated structure. The pull-up control module 31 can control a turning-on time for the pull-up module, and suppress ripples of the point Q(N) and output signal. When the second clock signal CKB raises from the low potential to the high potential, if the potential of the point Q(N) is coupled to the high potential by the second clock signal CKB, then the thin film transistor T13 turns on. The thin film transistor T13 and the thin film transistor T21 have the same size (W:L=2000 μm:8 μm), so that the thin film transistor T13 has the on-state capacitance which is relatively large, and the parasitic capacitance of the thin film transistor T13 can divide the voltage at the point Q(N). Thus, the ripple at the point Q(N) can be suppressed. Meanwhile, the thin film transistor T31 has the feedback function. If the ability of the second clock signal CKB coupling to the point Q(N) via the thin film transistor T21, the thin film transistor T22, and the thin film transistor T23 is not strong, then the thin film transistor T13 turns on weakly, the parasitic capacitance of the thin film transistor T13 is also relatively small, and the voltage divided to the point Q(N) is also relatively small. A function of the thin film transistor T6 is to pull up the potential of the point N and reduce leakage current at the point Q(N). The pull-up module 32 is mainly responsible for converting the clock signal into the stage-transfer signal Cout (N) and the output signal Out(N). A function of the bootstrap capacitor Cbt is responsible to pull up the potential of the point Q(N) again, which is beneficial to output the Out(N). The pull-down module 34 is responsible for pulling the potential of the point Q(N) down to the low potential at the first moment, and pulling the potential of the output signal Out(n) down to the low potential at the first moment. The pull-down holding circuit is responsible for maintaining the point Q(N) in a state of the low potential, and is responsible for maintaining the output signal Out(N) in the state of the low potential. The inverter 351 is to provide an inverting function between the potential of the point Q(N) and the potential of the point QB (N).

The present disclosure further provides a display panel, which includes anyone GOA circuit of the above embodiments.

Although the embodiments of the present disclosure have been described with reference to the accompanying drawings, those skilled in the art can make various modifications and variations without departing from the spirit and scope of the present disclosure. Such modifications and variations fall within the scope of the appended claims.

The embodiments of the present disclosure provide a GOA circuit. In an existing GOA circuit, as a size of thin film transistor increases, a parasitic capacitance of the thin film transistor increases. Because a drain of the thin film transistor is connected to a clock signal, when the clock signal raises from a low potential to a high potential, a potential signal at a pre-charging point is pulled up to the high potential, which easily causes a buffering thin film transistor to turn-on in error, and then the GOA outputs a high voltage, which in turn causes data signals to be written in error. In the present disclosure, a ripple at a pre-charging point can be suppressed by dividing a voltage at the pre-charging point via the voltage stabilization module, in order to improve stability of the device.

What is claimed is:

1. A gate driver on array (GOA) circuit, comprising a plurality of cascaded GOA units, each of GOA units comprising a node, a pull-up control module, a pull-up module, a transfer-down module, a pull-down module, and a pull-down holding module, wherein each of the pull-up control module, the pull-up module, the transfer-down module, the pull-down module, and the pull-down holding module is electrically connected to the node;

wherein the pull-up control module is configured to pull up a potential of the node;

wherein the pull-up module is configured to output an output signal under control of the potential of the node;

wherein the transfer-down module is configured to output a stage-transfer signal under control of the potential of the node;

wherein the pull-down module is configured to pull the potential of the node down to a low potential and pull the stage-transfer signal down to the low potential;

wherein the pull-down holding module is configured to maintain the node at the low potential and maintain the stage-transfer signal at the low potential; and wherein the pull-up control module comprises a voltage stabilization module electrically connected to the node and configured to divide a voltage of the node, the voltage stabilization module comprises a first thin film transistor, a gate of the first thin film transistor is connected to the node, and a source and a drain of the first thin film transistor are input with a first potential signal.

2. The GOA circuit as claimed in claim 1, wherein the cascaded GOA units comprises an N-th GOA unit, the N is a positive integer greater than 1, wherein the pull-up control module is input with an N-th output signal and an (N−1)th stage-transfer signal, and is electrically connected to a first node, and is configured to pull up a potential of the first node according to the N-th output signal under control of the (N−1)th stage-transfer signal;

wherein the pull-up module is input with a second clock signal, and is electrically connected to the first node, and is configured to output the N-th output signal according to the second clock signal under control of the potential of the first node;

wherein the transfer-down module is input with the second clock signal, and is electrically connected to the first node, and is configured to output an N-th stage-transfer signal according to the second clock signal under control of the potential of the first node;

wherein the pull-down module is input with an (N+1)th stage-transfer signal, the first potential signal, a second potential signal, and the N-th output signal, and is electrically connected to the first node, and is configured to change the potential of the first node to a potential of the first potential signal and change a potential of the N-th output signal to a potential of the second potential signal;

wherein the pull-down holding module comprises a first pull-down holding module and a second pull-down holding module;

wherein the first pull-down holding module is input with the first potential signal, and is electrically connected to the first node and a second node, and is configured to maintain the potential of the first node at the potential of the first potential signal under control of a potential of the second node; and wherein the second pull-down holding module is input with the second potential signal and the N-th output signal, and is electrically connected to the second node, and is configured to maintain the N-th output signal at the potential of the second potential signal under control of the potential of the second node.

3. The GOA circuit as claimed in claim 2, wherein the pull-up control module further comprises a second thin film transistor, a third thin film transistor, and a fourth thin film transistor; wherein a gate of the second thin film transistor is input with the (N−1)th stage-transfer signal, a source of the second thin film transistor is input with the N-th output signal, and a drain of the second thin film transistor is electrically connected to a source of the third thin film transistor; wherein a gate of the third thin film transistor is input with the (N−1)th stage-transfer signal, and a drain of the third thin film transistor is electrically connected to the first node;

wherein a gate of the fourth thin film transistor is input with the N-th stage-transfer signal, a source of the fourth thin film transistor is electrically connected to the drain of the second thin film transistor, and a drain of the fourth thin film transistor is electrically connected to the pull-up module; and wherein the pull-up module comprises a fifth thin film transistor, a sixth thin film transistor, and a bootstrap capacitor; wherein the a gate of the fifth thin film transistor is electrically connected to the first node, a source of the fifth thin film transistor is input with the second clock signal, and a drain of the fifth thin film transistor outputs the N-th output signal; wherein a gate of the sixth thin film transistor is electrically connected to the first node, a source of the sixth thin film transistor is input with the second clock signal, and a drain of the sixth thin film transistor is electrically connected to the drain of the fourth thin film transistor; and wherein the bootstrap capacitor has two ends, one of the two ends is connected to the first node, and the other of the two ends is input with the N-th output signal.

4. The GOA circuit as claimed in claim 3, wherein the first thin film transistor and the fifth thin film transistor have a same size.

5. The GOA circuit as claimed in claim 4, wherein a width-to-length ratio of the first thin film transistor is 2000 μm:8 μm.

6. The GOA circuit as claimed in claim 1, wherein the first thin film transistor is an indium gallium zinc oxide (IGZO) thin film transistor.

7. The GOA circuit as claimed in claim 1, wherein the first thin film transistor comprises a glass substrate, a gate electrode, an oxide semiconductor layer, a gate insulation layer, the source, and the drain, which are stacked.

8. The GOA circuit as claimed in claim 2, wherein the pull-down holding module comprises an inverter, the inverter comprises a seventh thin film transistor, an eighth thin film transistor, a ninth thin film transistor, and a tenth thin film transistor; wherein a gate and a source of the seventh thin film transistor are input with a constant high-potential voltage, and a drain of the seventh thin film transistor is electrically connected to a source of the eighth thin film transistor; wherein a gate of the eighth thin film transistor is electrically connected to the first node, and a drain of the eighth thin film transistor is input with the first potential signal; wherein a gate of the ninth thin film transistor is electrically connected to the drain of the seventh thin film transistor, a source of the ninth thin film transistor is input with the constant high-potential voltage, and a drain of the ninth thin film transistor is electrically connected to the second node; and wherein a gate of the tenth thin film transistor is electrically connected to the first node, a source of the tenth thin film transistor is electrically connected the second node, and a drain of the tenth thin film transistor is input with the first potential signal.

9. A display panel, comprising a gate driver on array (GOA) circuit comprising a plurality of cascaded GOA units, each of GOA units comprising a node, a pull-up control module, a pull-up module, a transfer-down module, a pull-down module, and a pull-down holding module, wherein each of the pull-up control module, the pull-up module, the transfer-down module, the pull-down module, and the pull-down holding module is electrically connected to the node;

wherein the pull-up control module is configured to pull up a potential of the node;

wherein the pull-up module is configured to output an output signal under control of the potential of the node;

wherein the transfer-down module is configured to output a stage-transfer signal under control of the potential of the node;

wherein the pull-down module is configured to pull the potential of the node down to a low potential and pull the stage-transfer signal down to the low potential;

wherein the pull-down holding module is configured to maintain the node at the low potential and maintain the stage-transfer signal at the low potential; and wherein the pull-up control module comprises a voltage stabilization module electrically connected to the node and configured to divide a voltage of the node, the voltage stabilization module comprises a first thin film transistor, a gate of the first thin film transistor is connected to the node, and a source and a drain of the first thin film transistor are input with a first potential signal.

10. The display panel as claimed in claim 9, wherein the cascaded GOA units comprises an N-th GOA unit, the N is a positive integer greater than 1, wherein the pull-up control module is input with an N-th output signal and an (N−1)th stage-transfer signal, and is electrically connected to a first node, and is configured to pull up a potential of the first node according to the N-th output signal under control of the (N−1)th stage-transfer signal;

wherein the pull-up module is input with a second clock signal, and is electrically connected to the first node, and is configured to output the N-th output signal according to the second clock signal under control of the potential of the first node;

wherein the transfer-down module is input with the second clock signal, and is electrically connected to the first node, and is configured to output an N-th stage-transfer signal according to the second clock signal under control of the potential of the first node;

wherein the pull-down module is input with an (N+1) stage-transfer signal, the first potential signal, a second potential signal, and the N-th output signal, and is electrically connected to the first node, and is configured to change the potential of the first node to a potential of the first potential signal and change a potential of the N-th output signal to a potential of the second potential signal;

wherein the pull-down holding module comprises a first pull-down holding module and a second pull-down holding module;

wherein the first pull-down holding module is input with the first potential signal, and is electrically connected to the first node and a second node, and is configured to maintain the potential of the first node at the potential of the first potential signal under control of a potential of the second node; and wherein the second pull-down holding module is input with the second potential signal and the N-th output signal, and is electrically connected to the second node, and is configured to maintain the N-th output signal at the potential of the second potential signal under control of the potential of the second node.

11. The display panel as claimed in claim 10, wherein the pull-up control module further comprises a second thin film transistor, a third thin film transistor, and a fourth thin film transistor; wherein a gate of the second thin film transistor is input with the (N−1)th stage-transfer signal, a source of the second thin film transistor is input with the N-th output signal, and a drain of the second thin film transistor is electrically connected to a source of the third thin film transistor; wherein a gate of the third thin film transistor is input with the (N−1)th stage-transfer signal, and a drain of the third thin film transistor is electrically connected to the first node;

wherein a gate of the fourth thin film transistor is input with the N-th stage-transfer signal, a source of the fourth thin film transistor is electrically connected to the drain of the second thin film transistor, and a drain of the fourth thin film transistor is electrically connected to the pull-up module; and wherein the pull-up module comprises a fifth thin film transistor, a sixth thin film transistor, and a bootstrap capacitor; wherein the a gate of the fifth thin film transistor is electrically connected to the first node, a source of the fifth thin film transistor is input with the second clock signal, and a drain of the fifth thin film transistor outputs the N-th output signal; wherein a gate of the sixth thin film transistor is electrically connected to the first node, a source of the sixth thin film transistor is input with the second clock signal, and a drain of the sixth thin film transistor is electrically connected to the drain of the fourth thin film transistor; and wherein the bootstrap capacitor has two ends, one of the two ends is connected to the first node, and the other of the two ends is input with the N-th output signal.

12. The display panel as claimed in claim 11, wherein the first thin film transistor and the fifth thin film transistor have a same size.

13. The display panel as claimed in claim 12, wherein a width-to-length ratio of the first thin film transistor is 2000 μm:8 μm.

14. The display panel as claimed in claim 9, wherein the first thin film transistor is an indium gallium zinc oxide (IGZO) thin film transistor.

15. The display panel as claimed in claim 9, wherein the first thin film transistor comprises a glass substrate, a gate electrode, an oxide semiconductor layer, a gate insulation layer, the source, and the drain, which are stacked.

16. The display panel as claimed in claim 10, wherein the pull-down holding module comprises an inverter, the inverter comprises a seventh thin film transistor, an eighth thin film transistor, a ninth thin film transistor, and a tenth thin film transistor; wherein a gate and a source of the seventh thin film transistor are input with a constant high-potential voltage, and a drain of the seventh thin film transistor is electrically connected to a source of the eighth thin film transistor; wherein a gate of the eighth thin film transistor is electrically connected to the first node, and a drain of the eighth thin film transistor is input with the first potential signal; wherein a gate of the ninth thin film transistor is electrically connected to the drain of the seventh thin film transistor, a source of the ninth thin film transistor is input with the constant high-potential voltage, and a drain of the ninth thin film transistor is electrically connected to the second node; and wherein a gate of the tenth thin film transistor is electrically connected to the first node, a source of the tenth thin film transistor is electrically connected the second node, and a drain of the tenth thin film transistor is input with the first potential signal.

* * * * *